US010640877B2

(12) United States Patent
Simpson et al.

(10) Patent No.: US 10,640,877 B2
(45) Date of Patent: May 5, 2020

(54) CATHODIC CORROSION PROTECTION

(71) Applicant: Vector Corrosion Technologies Ltd., Winnipeg (CA)

(72) Inventors: David Matthew Simpson, Halesowen (GB); George Sergi, Park Hall (GB); Tejal Nikita Rathod, Hall Green (GB); David William Whitmore, Winnipeg (CA)

(73) Assignee: Vector Remediation Ltd., Winnipeg, MB (CA)

( * ) Notice: Subject to any disclaimer, the term of this patent is extended or adjusted under 35 U.S.C. 154(b) by 436 days.

(21) Appl. No.: 15/341,532

(22) Filed: Nov. 2, 2016

(65) Prior Publication Data

US 2017/0121828 A1 May 4, 2017

Related U.S. Application Data

(60) Provisional application No. 62/250,153, filed on Nov. 3, 2015.

(51) Int. Cl.

| | |
|---|---|
| ***C23F 13/08*** | (2006.01) |
| ***C23F 13/20*** | (2006.01) |
| ***C23F 13/06*** | (2006.01) |

(52) U.S. Cl.

CPC ..... *C23F 13/20* (2013.01); *C23F 13/06* (2013.01); *C23F 2201/02* (2013.01)

(58) Field of Classification Search

CPC ..... C23F 13/02; C23F 13/04; C23F 13/06; C23F 13/08; C23F 13/10; C23F 13/16; C23F 13/20; C23F 13/22; C23F 2201/00–02; C23F 2213/10; C23F 2213/20; C23F 2213/30–32; C04B 2111/265

See application file for complete search history.

(56) References Cited

U.S. PATENT DOCUMENTS

| | | | | |
|---|---|---|---|---|
| 5,649,591 | A * | 7/1997 | Green | F28F 19/004 165/134.1 |
| 7,226,532 | B2 | 6/2007 | Whitmore | |
| 7,264,708 | B2 | 9/2007 | Whitmore | |
| 8,961,746 | B2 | 2/2015 | Sergi | |
| 8,968,549 | B2 | 3/2015 | Sergi | |
| 2006/0108235 | A1 | 5/2006 | Whitmore | |

(Continued)

FOREIGN PATENT DOCUMENTS

| | | |
|---|---|---|
| JP | H9-31675 | 2/1997 |
| JP | 2006-37118 | 2/2006 |
| JP | 2015-525832 | 9/2015 |

*Primary Examiner* — Alexander W Keeling

(74) *Attorney, Agent, or Firm* — Adrian D. Battison; Ade & Company Inc.; Michael R. Williams

(57) ABSTRACT

In a method for cathodically protecting and/or passivating a metal section in an ionically conductive material such as steel reinforcement in concrete or mortar, an impressed current or sacrificial anode communicates electrical current to the metal section and a storage component of electrical energy which can be a cell, battery or capacitor is provided as a component of the anode. The storage component can have replacement energy introduced by re-charging or replacing the component from an outside supply. Typically the cell or storage capacitor has an outer case which carries an anode material as an integral outer component.

18 Claims, 10 Drawing Sheets

(56) References Cited

U.S. PATENT DOCUMENTS

| | | | | |
|---|---|---|---|---|
| 2012/0261270 | A1* | 10/2012 | Glass | C23F 13/06 205/734 |
| 2014/0021062 | A1* | 1/2014 | Sergi | C23F 13/14 205/730 |
| 2015/0068919 | A1* | 3/2015 | Burns | C23F 13/12 205/724 |
| 2015/0090607 | A1* | 4/2015 | Galande | C23F 13/06 205/724 |
| 2015/0284860 | A1 | 10/2015 | Glass et al. | |

* cited by examiner

CATHODIC CORROSION PROTECTION

This application claims the benefit under 35 USC 119 (e) of Provisional application 62/250,153 filed Nov. 3, 2015.

This invention relates to a method and/or an anode assembly for cathodically protecting and/or passivating a metal section in an ionically conductive material using a cell or battery of cells to provide a voltage.

BACKGROUND OF THE INVENTION

Impressed current systems using a battery are known. Such impressed current systems can use other types of power supply including common rectifiers which rectify an AC voltage from a suitable source into a required DC voltage for the impressed current between the anode and the steel. It is also known to provide solar panels to be used in a system of this type.

In all cases such impressed current systems require regular maintenance and checking of the status of the power supply to ensure that the power supply does not fail leading to unexpected and unacceptable corrosion or overprotection of the steel within the structure to be protected. While such maintenance can be carried out and the power supply thus ensured, this is a relatively expensive process.

Alternatively galvanic systems can be used which avoid necessity for any power supply since the voltage between the steel and the anode is provided by selecting a suitable material for the anode which is sufficiently electro-negative to ensure that a current is generated to provide corrosion protection. These systems have obtained considerable success and are widely used.

There are two primary limitations of ordinary galvanic anodes as used in steel reinforced concrete. The first relates to the mass of zinc per anode which, depending on the required current output, limits the useful life of the anode. The second is the actual current output of the anode which may or may not be sufficient to halt corrosion of the steel. The current output is limited by the driving voltage, which is essentially a fixed property and varies with exposure conditions, age of the anode, and build-up of corrosion products over time.

Reference is also made to U.S. Pat. No. 8,961,746 (Sergi) issued Feb. 24, 2015, U.S. Pat. No. 8,968,549 Mar. 3, 2015 (Sergi) and U.S. Pat. No. 7,264,708 (Whitmore) issued Sep. 4, 2007 all issued to the present assignees the disclosures of which are incorporated herein by reference or may be referenced for more relevant information.

SUMMARY OF THE INVENTION

According to one aspect of the invention there is provided a method for cathodically protecting and/or passivating a metal section in an ionically conductive material, comprising:

providing a cell or battery of cells with two poles;

providing an anode of a material which is not sacrificial to the metal section;

electrically connecting one pole to the metal section, electrically connecting the other pole to the anode and placing the anode in contact with the ionically conductive material such that electrons can flow from the cell or battery of cells through the electrical connection to the metal section;

the cell or battery of cells being connected as a single unit with the anode.

According to a second aspect of the invention which is usable independently of the first aspect, there is provided a method for cathodically protecting and/or passivating a metal section in an ionically conductive material, comprising:

providing an anode for communication of an electrical current to the metal section in the ionically conductive material;

providing a storage component of electrical energy with two poles for communicating electrical current generated by release of the electrical energy;

electrically connecting one pole to the metal section, electrically connecting the other pole to the anode and placing the anode in ionic contact with the ionically conductive material such that the electrical current can flow from the storage component through the electrical connection to the metal section;

wherein replacement electrical energy is introduced into the storage component while in situ.

According to a third aspect of the invention which is usable independently of the other aspects defined herein, there is provided a method for cathodically protecting and/or passivating a metal section in an ionically conductive material, comprising:

providing an anode for communication of an electrical current to the metal section in the ionically conductive material where the anode is of a material which is not sacrificial to the metal section;

providing a storage component of electrical energy with two poles for communicating electrical current generated by release of the electrical energy;

electrically connecting one pole to the metal section, electrically connecting the other pole to the anode and placing the anode in ionic contact with the ionically conductive material such that the electrical current can flow from the storage component through the electrical connection to the metal section thus reducing a total amount of electrical energy contained in the container;

wherein the storage component is connected as a single unit with the anode.

According to a fourth aspect of the invention which is usable independently of the other aspects defined herein, there is provided a method for cathodically protecting and/or passivating a metal section in an ionically conductive material, comprising:

providing an anode for communication of an electrical current to the metal section in the ionically conductive material;

providing a capacitor for storage of electrical energy with two poles for communicating electrical current generated by release of the electrical energy;

and electrically connecting one pole to the metal section, electrically connecting the other pole to the anode and placing the anode in ionic contact with the ionically conductive material such that the electrical current can flow from the capacitor through the electrical connection to the metal section.

According to a fifth aspect of the invention which is usable independently of the other aspects defined herein, there is provided a method for cathodically protecting and/or passivating a metal section in an ionically conductive material, comprising:

providing a stainless steel anode for communication of an electrical current to the metal section in the ionically conductive material;

providing a storage component of electrical energy with two poles for communicating electrical current generated by release of the electrical energy;

electrically connecting one pole to the metal section and electrically connecting the other pole to the anode and placing the stainless steel anode in ionic contact with the ionically conductive material such that the electrical current can flow from the storage component through the electrical connection to the metal section.

According to a sixth aspect of the invention which is usable independently of the other aspects defined herein, there is provided a method for cathodically protecting and/or passivating a metal section in an ionically conductive material, comprising:

providing an anode for communication of an electrical current to the metal section in the ionically conductive material;

providing a storage component of electrical energy with two poles for communicating electrical current generated by release of the electrical energy;

electrically connecting one pole to the metal section and electrically connecting the other pole to the anode and placing the stainless steel anode in ionic contact with the ionically conductive material such that the electrical current can flow from the storage component through the electrical connection to the metal section;

locating the storage component in a container;

and after a period of operation, replacing the storage component in the container with a replacement storage component to provide additional electrical energy.

Where, as stated above the anode is not sacrificial to the metal section, typically the material is therefore electropositive relative to the metal section. However some part of the anode may be sacrificial or the anode may be partially sacrificial.

The arrangement herein can be used where the anode is in the form of a plurality of associated anodes all connected to the cell or battery of cells.

The storage component as defined above can be a cell or battery or battery of cells/batteries or it can be a capacitor or a supercapacitor or ultracapacitor which provides a system for storing charge different from conventional electrolytic cells or batteries. A supercapacitor is a high-capacity electrochemical capacitor with capacitance values much higher than other capacitors. These capacitors typically have lower voltage limits than standard or conventional capacitors. They typically store 10 to 100 times more energy per unit volume or mass than standard capacitors, can accept and deliver charge much faster than batteries, and tolerate many more charge and discharge cycles than rechargeable batteries. Supercapacitors do not use the conventional solid dielectric of standard capacitors. They use electrostatic double-layer capacitance or electrochemical pseudo-capacitance or a combination of both instead. Electrostatic double-layer capacitors use carbon electrodes or derivatives with much higher electrostatic double-layer capacitance than electrochemical pseudo-capacitance, achieving separation of charge in a Helmholtz double layer at the interlace between the surface of a conductive electrode and an electrolyte. The separation of charge is of the order of a few ångstroms (0.3-0.8 nm), much smaller than in a conventional capacitor.

Supercapacitors are a great advancement on normal capacitors being capable of storing a high charge once fully charged. The capacity of a 2.7V 200 F supercapacitor is capable of holding a charge of the order of over 500 C (A×seconds). Typical cathodic protection systems require around 170 to 400 C/m2 of steel per day so such a capacitor is able to provide, when fully charged, enough charge to protect 1 m2 or more of steel for a day. This represents 2-5 mA/m2 current density. In order for example to double this figure then we need to double the capacitance to around 400 F. If the capacitor is recharged on a daily basis, then logistically a system utilising supercapacitors of this size spaced at intervals to provide current for 1 m2 or more of steel can be an effective cathodic protection system. Daily recharging can easily be provided by solar panels, for example, but other means of producing reasonably regular bursts of current could be used as charging components for the supercapacitors. An example of such could be piezoelectric materials which can be incorporated in roads, parking garages, bridges, runways etc. enabling current to be generated by loading and/or movement of the structure or vehicles passing over them.

That is, piezoelectric materials could be used to generate electricity to power an impressed current system directly, or to charge/recharge batteries or capacitors/supercapacitors.

In some embodiments the anode is a sacrificial anode formed of a material which is less noble than the metal section to be protected. However in other cases the anode is not less noble than the metal sections to be protected so that it is the same as the metal, typically steel or is more noble than the steel; so that it is partially or fully inert during the process. If the anode is formed of a sufficiently inert material anode it does not corrode significantly during the flow of the electrons.

High current output is required from the storage component such as a battery. As described above, one pole is connected to the metal section to be protected. Electrons flow from the storage component to the metal section such that corrosion of the metal section is reduced. The other pole is connected to an anode or if suitable, the casing of the storage component itself can be used as the anode. In the case of a zinc-alkaline battery the polarity of the battery is such that the case of the battery, if it is made of a suitable material will act as the anode and will be able to distribute the necessary current through the ionically conductive material such as mortar or concrete. Other batteries, such as most lithium batteries, typically have only a small pole which has the proper polarity which may not be large enough to deliver the required current into the ionically conductive material. A separate anode can be provided for connection to the appropriate pole. The anode may encase or coat the whole storage component such as a battery or capacitor. Anodes can be made of any inert conductive material such as MMO coated titanium or other noble metal or sub-metal, conductive coating, conductive ceramic material etc. and can be embedded in an alkaline mortar or an inert material such as sand which may be dosed with an alkali solution. Stainless steel can also be a suitable current carrier when embedded in mortar or compacted sand dosed with alkali such as a saturated solution of lithium hydroxide. Anodes may also comprise sacrificial materials such as zinc which are less noble than the metal section to be protected.

Preferably in some embodiments the storage component is initially charged or is subsequently re-charged while in situ that is while in contact with the ionically conductive material. The arrangement may include or preferably includes automatic switching systems to effect the periodic charging process. For example the storage component can be charged by a solar cell or by an outside power source such as a second battery or a power supply. Also in some cases there may be provided a system which operates to subsequently automatically and repeatedly or periodically carry out the re-charge.

In another case, the storage component is subsequently re-charged by a recharging power supply which is an integral unit with the anode and the storage component. However the system also may operate as a periodic maintenance programme where a power supply is brought into operation periodically as required to effect the re-charging of an anode assembly or a set of anode assemblies in a structure.

Preferably the storage component is subsequently re-charged by applying voltage directly between both terminals or between a first connection to a terminal of the storage component and a second connection to the metal section.

In one arrangement the anode comprises sacrificial anode material, or the anode, which is sacrificial to the metal section, is collated with or in electrical contact with a body of sacrificial anode material which gives a boost of current until the sacrificial anode material is consumed, following which the current discharge is through the anode.

In one arrangement storage component is connected to the metal section and is charged, in an initial charging step or in a subsequent re-charging, after installation by a connection to the one terminal and a second connection to the metal section. This method of connection acts to pass extra current to the metal section during the charging or re-charging step to passivate the metal section or reduce future current requirement to maintain passivity or mitigate corrosion of the metal section.

Typically the single unit comprising the storage component and the anode or anodes is at least partly buried in the ionically conductive material. However application to the surface or other modes of mounting where the anode is in ionic contact with the material can be used.

In one particularly preferred arrangement the storage component comprises a cell with an outer case wherein the case is fully or partially formed of the anode material so that the anode is formed by the outer case either by an outer surface of the same material or as a coating or layer on the exterior of the case. In this case the outer case or at least the outer layer can be formed of a material which is more noble than steel. In this arrangement the anode forms directly the outer case of the cell where the case contains and houses the cathode material of the cell the electrolyte, the anode material and other components of the cell. That is, in this embodiment, the anode is defined by a layer or coating on the outer surface of the storage component itself or actually as the outer surface of the storage component and not as an additional element which is separate from the storage component. Where the storage component is a cell, the outer case of the cell can directly carry the material of the anode or even the outer case of the cell is the anode. The anode material may cover the whole surface or may be a partial covering leaving other areas exposed.

In another case the case and the anode are formed independently and the anode forms a separate body which conforms in shape to the outer case of the cell. Typically such cells are cylindrical but other shapes can be used. This arrangement is particularly applicable where the cell is replaceable rather than rechargeable to introduce the additional energy after the original cell is sufficiently depleted to be no longer effective.

In another case the anode is a separate body which is electrically connected to one terminal of the storage component.

The above features can be preferably used for protection of steel reinforcing or structural members in concrete or mortar material where it is well known that corrosion can cause breakdown of the concrete due to the expansive forces of the corrosion products and due to the reduction to the steel strength. However uses in other situations can arise.

The term impressed current anode used herein is intended to distinguish from the sacrificial anode where the sacrificial anode is formed of a material, typically of zinc, which is less noble than the metal section so that it preferentially corrodes relative to the metal section to be protected. The impressed current anode is one which is used in conjunction with an external power supply and does not need to be less noble than the metal section. Typically such impressed current anodes are formed of titanium, platinum, niobium, carbon and other noble metals and oxides which do not corrode readily, or they can be formed of iron or less noble materials such as zinc.

For use during a sacrificial or galvanic phase of operation of the above method, the ionically conductive filler material preferably contains at least one activator to ensure continued corrosion of the sacrificial anode. However the activator can also be located at other positions in the system. Suitable filler materials can be in the form of solids, gels or liquids.

Gels can include carbomethyl cellulose, starches and their derivatives, fumed silica or polymer gel electrolytes, e.g. acrylic acid in a potassium hydroxide solution or polyvinyl chloride/acetate-KOH composites with additions of bentonite, propylene carbonate and or alumina. The alkali hydroxide in these gels acts as a suitable activator.

Suitable activators include alkali hydroxides, humectants, catalytic materials and other materials which are corrosive to the sacrificial anode metal. Activators may be used alone or in combination.

For use during a sacrificial or galvanic phase of operation of the above method, the ionically conductive filler material preferably has a pH sufficiently high for corrosion of the sacrificial anode to occur and for passive film formation on the sacrificial anode to be avoided. Alternatively, the filler may have a lower pH and/or contain other activators for corrosion of the sacrificial anode to occur and for passive film formation on the sacrificial anode to be avoided.

The anode and methods herein are preferably designed for use where the metal section is steel and the ionically conductive material is concrete or mortar.

The anode apparatus including the impressed current and sacrificial components is typically buried in the concrete or other solid material so that it is fully encased by the concrete or a filler material, but this is not essential and the anode may be only partially buried or in direct or indirect physical or ionic contact with the concrete.

The anode apparatus including the impressed current and sacrificial components may be surrounded by an encapsulating material or ionically conducting filler material which may be a porous material or porous mortar material. Suitable encapsulating materials can be inorganic or organic and may be any ionically conductive cementitious, polymer or non-cementitious material or mortar including geopolymers or modified Portland cements. The encapsulating material may be solid, gel or liquid and may be deformable.

The power supply may include a solar panel which drives the impressed current anode and rechargeable galvanic anode so as to provide long term protection when the solar power is on and off.

The construction and methods proposed herein are designed particularly where the metal section is steel and the ionically conductive material is concrete or mortar. However the same arrangements may be used in other corrosion protection systems such as for pipes or other constructions in soil, and in many other systems where such anodes can be used.

Preferably the assembly includes a reinforcing layer, such as disclosed in U.S. Pat. No. 7,226,532 issued Jun. 5, 2007 to Whitmore, the disclosure of which is incorporated by reference or to which reference may be made for further details not disclosed herein, to restrain and resist forces such as expansion, contraction and deformation forces which may be caused by corrosion of the anodes, deposition of sacrificial anode ions and other physical/environmental forces such as freezing, thawing, wetting, drying and thermal expansion/contraction.

The invention as defined and described herein can also be provided as an assembly, as opposed to a method for cathodically protecting and/or passivating a metal section in an ionically conductive material. Thus the following definitions of the invention presented herein are included herein. Each of these independent definitions can be used in conjunction with any one of or all of the subsidiary features as defined above.

An assembly for cathodically protecting and/or passivating a metal section in an ionically conductive material, comprising:

an anode of a material which is not sacrificial to the metal section;

a storage component of electrical energy with two poles for communicating electrical current generated by release of the electrical energy;

an arrangement for electrically connecting one pole to the metal section;

an arrangement for electrically connecting the other pole to the anode;

the assembly being arranged for placing the anode in ionic contact with the ionically conductive material such that electrons can flow from the storage component through the electrical connection to the metal section;

the storage component being connected as a single unit with the anode.

An assembly for cathodically protecting and/or passivating a metal section in an ionically conductive material, comprising:

an anode;

a storage component of electrical energy with two poles for communicating electrical current generated by release of the electrical energy;

an arrangement for connection of one pole to the metal section;

an arrangement for electrically connecting the other pole to the anode;

the assembly being arranged for placing the anode in ionic contact with the ionically conductive material such that electrons can flow from the cell or battery of cells through the electrical connection to the metal section;

wherein the anode comprises at least part of an outer surface of the storage component.

An assembly for cathodically protecting and/or passivating a metal section in an ionically conductive material, comprising:

an anode for communication of an electrical current to the metal section in the ionically conductive material;

a container including a storage component of electrical energy with two poles for communicating electrical current generated by release of the electrical energy;

an arrangement for connection of one pole to the metal section;

an arrangement for electrically connecting the other pole to the anode;

the assembly being arranged for placing the anode in ionic contact with the ionically conductive material such that electrons can flow from the cell or battery of cells through the electrical connection to the metal section;

wherein the storage component is rechargeable.

An assembly for cathodically protecting and/or passivating a metal section in an ionically conductive material, comprising:

an anode for communication of an electrical current to the metal section in the ionically conductive material;

a container including a storage component of electrical energy with two poles for communicating electrical current generated by release of the electrical energy;

an arrangement for connection of one pole to the metal section;

an arrangement for electrically connecting the other pole to the anode;

the assembly being arranged for placing the anode in ionic contact with the ionically conductive material such that electrons can flow from the cell or battery of cells through the electrical connection to the metal section;

wherein the storage component is replaceable.

An assembly for cathodically protecting and/or passivating a metal section in an ionically conductive material, comprising:

an anode for communication of an electrical current to the metal section in the ionically conductive material;

a container including a storage component of electrical energy with two poles for communicating electrical current generated by release of the electrical energy;

an arrangement for connection of one pole to the metal section;

an arrangement for electrically connecting the other pole to the anode;

the assembly being arranged for placing the anode in ionic contact with the ionically conductive material such that electrons can flow from the cell or battery of cells through the electrical connection to the metal section;

wherein the storage component is a capacitor.

An assembly for cathodically protecting and/or passivating a metal section in an ionically conductive material, comprising:

an anode for communication of an electrical current to the metal section in the ionically conductive material;

a container including a storage component of electrical energy with two poles for communicating electrical current generated by release of the electrical energy;

an arrangement for connection of one pole to the metal section;

an arrangement for electrically connecting the other pole to the anode;

the assembly being arranged for placing the anode in ionic contact with the ionically conductive material such that electrons can flow from the cell or battery of cells through the electrical connection to the metal section;

wherein the storage component has an outer surface at least partly of stainless steel.

BRIEF DESCRIPTION OF THE DRAWINGS

Embodiments of the invention will now be described in conjunction with the accompanying drawings in which.

In the drawings like characters of reference indicate corresponding parts in the different figures.

DETAILED DESCRIPTION

Figure 1:
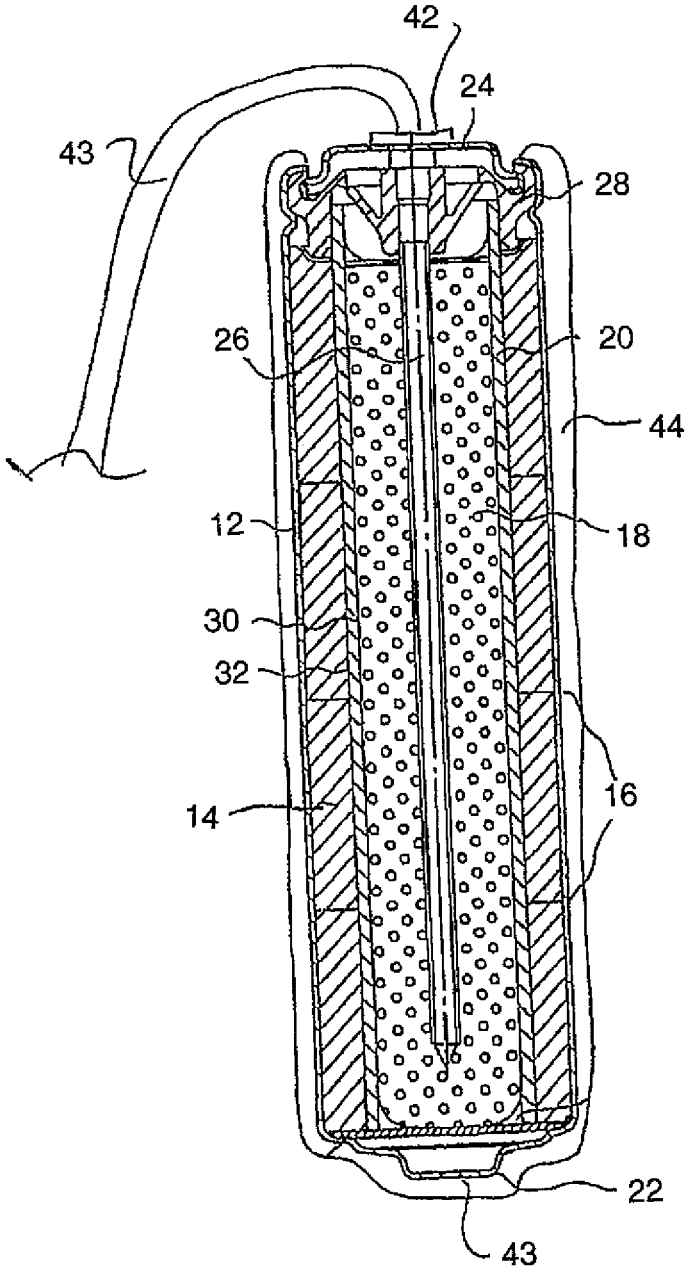
FIG. 1 is a schematic illustration of a corrosion protection method according to the present invention using a first arrangement of anode apparatus.

As shown in FIG. 1, a typical alkaline manganese dioxide-zinc rechargeable cell comprises the following main units: a steel can 12 defining a cylindrical inner space, a manganese dioxide cathode 14 formed by a plurality of hollow cylindrical pellets 16 pressed in the can, a zinc anode 18 made of an anode gel and arranged in the hollow interior of the cathode 14, and a cylindrical separator 20 separating the anode 18 from the cathode 14. The ionic conductivity (electrolyte) between the anode and the cathode is provided by the presence of potassium hydroxide, KOH, electrolyte added into the cell in a predetermined quantity. Other types of rechargeable cells comprise similar main components (can, cathode, anode, separator and electrolyte) but the composition of the components may differ. Some of the types of cell may however be of a different construction such as lead/acid cells or lithium cells.

The can 12 is closed at the bottom, and it has a central circular pip 22 serving as the positive terminal. The upper end of the can 12 is hermetically sealed by a cell closure assembly which comprises a negative cap 24 formed by a thin metal sheet, a current collector nail 26 attached to the negative cap 24 and penetrating deeply into the anode gel to provide electrical contact with the anode, and a plastic top 28 electrically insulating the negative cap 24 from the can 12 and separating gas spaces formed beyond the cathode and anode structures, respectively.

The material of separator 20 consists of two different materials, i.e.: a first material 30 made of fibrous sheet material wettable by the electrolyte, and a second material 32 being impermeable to small particles but retaining ionic permeability. An expedient material for the first layer is a sheet material of non-woven polyamide fiber, which is absorbent and serves as a reservoir for electrolyte. The macro-porous structure of the absorbent layer cannot prevent internal shorting by zinc dendrites or deposits during discharge/charge cycling.

Shorting is prevented by the second 32 material which may be a layer or layers of micro-porous or non-porous material which may be laminated to or coated onto the fibrous sheet material. One suitable material is one or more cellophane membranes laminated to the non-woven polyamide sheet. Another is one or more coatings of regenerated cellulose or viscose coated onto and partially impregnating the non-woven polyamide sheet, resulting in a composite material.

Figure 2:
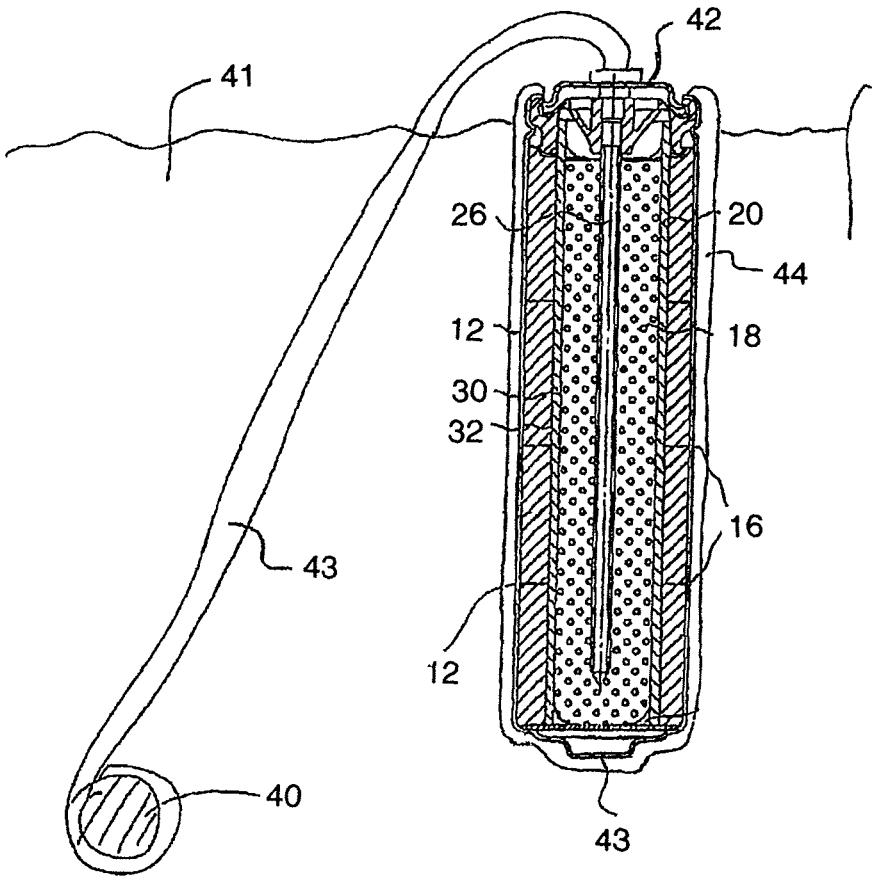
FIG. 2 is the schematic illustration of FIG. 1 showing the connection of the components for operation in the impressed current sacrificial protection mode.

Other types of rechargeable cells may be used. In the present arrangement, the type described above is used in a method for cathodically protecting and/or passivating a metal section such as steel reinforcing bar 40 in an ionically conductive material such as concrete 41. The cell therefore includes a first terminal 42 and a second terminal 43 defined by the outer casing 12. The first terminal 42 is connected to the pin or nail 26 which is engaged into the anode material 18. The terminal 42 connects to a connecting wire 42A which extends from the anode material 18 for connection to the steel reinforcing bar 40 as shown in FIG. 2. In practice the pin 26 and the wire 42A together with the terminal 42 may all form an integral structure where the wire extends into the anode material in the form of the pin 26 or is sufficiently welded, soldered, clamped or otherwise electrically connected. This is to ensure an effective connection between the wire 42A and the anode material 18.

In FIG. 1, anode 44 is applied as a coating onto the casing 12 of the cell. In this embodiment the anode 44 is of an inert material so that it is more noble than steel. Examples of such materials are well known. Thus the anode material 44 does not corrode or significantly corrode during the cathodic protection process.

The terminal 42 is connected to the steel reinforcement 40 by the wire 42A. Other electrical connection methods and materials may be used. The wire may comprise steel, copper, brass or titanium. The wire may comprise a layer of a second metal or alloy or a layer of insulation. The second terminal defined by the casing is connected to the anode by the contiguous surface therebetween. As shown in FIG. 2, the anode 44 is placed in contact with the ionically conductive material or concrete 41 so that electrons can flow from the cell through the electrical connector 43 to the metal section 40.

In this arrangement the application of the anode 44 onto the outside surface of the casing 12 provides the structure as a common single unit where the anode is directly connected to the cell and forms an integral element with the cell. Anode 44 may comprise one or more layers and may include a mixed metal oxide (MMO), catalytic or sub-oxide layer.

In this embodiment, as the anode is formed of an inert material which does not corrode in the protection process, the anode and the cell contained therein can be directly incorporated or buried in to the concrete or other ionically conductive material without the necessity for an intervening encapsulating material such as a porous mortar matrix. As there are no corrosion products there is no requirement to absorb such products or the expansive forces generated thereby. As the process does not depend upon continued corrosion of a sacrificial anode, there is no necessity for activators at the surface of the anode. As the chemical reaction at the surface of any inert anode during operation generates acid (or consumes alkali) it is beneficial for the anode to be buried in an alkaline material such as concrete or high alkalinity mortar to prevent material near the anode from becoming acidic. If desired, additional alkali may be added to the concrete or other material the anode is in contact with.

Figure 3:
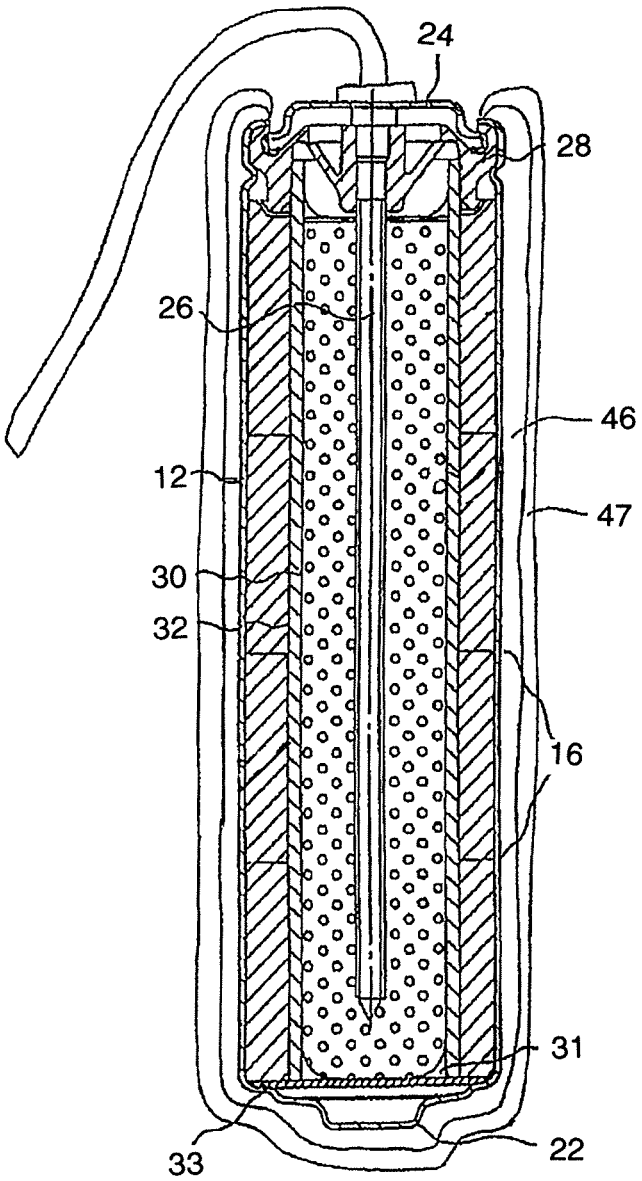
FIG. 3 is a schematic illustration of a corrosion protection method according to the present invention using a second arrangement of anode apparatus.

Turning now to FIG. 3 there is shown an alternative arrangement where the same cell is connected to and uses an anode 46 formed of a sacrificial material such as zinc. Again therefore the anode is applied as a coating onto the outside surface of the casing. Around the sacrificial anode 46 is provided a porous or reinforced matrix 47 which is arranged to absorb any expansive forces caused by the corrosion of the sacrificial anode 46 and which may contain activators of a conventional construction for ensuring continued corrosion of the sacrificial material.

In another embodiment the casing 12 is formed of a suitable inert material more noble than steel and the sacrificial material of the anode 46 is formed as a thin coating or a separate body which corrodes away after a relatively short period of time leaving the inert anode defined by the casing to continue further cathodic protection. In this way the inert anode defined by the casing is collated with or in electrical contact with the body of the sacrificial anode material 46 and the anode material acts to provide an initial boost of current until the sacrificial anode material is consumed, following which the further cathodic protection is obtained by the current discharge through the inert anode defined by the casing 12.

Figure 4:
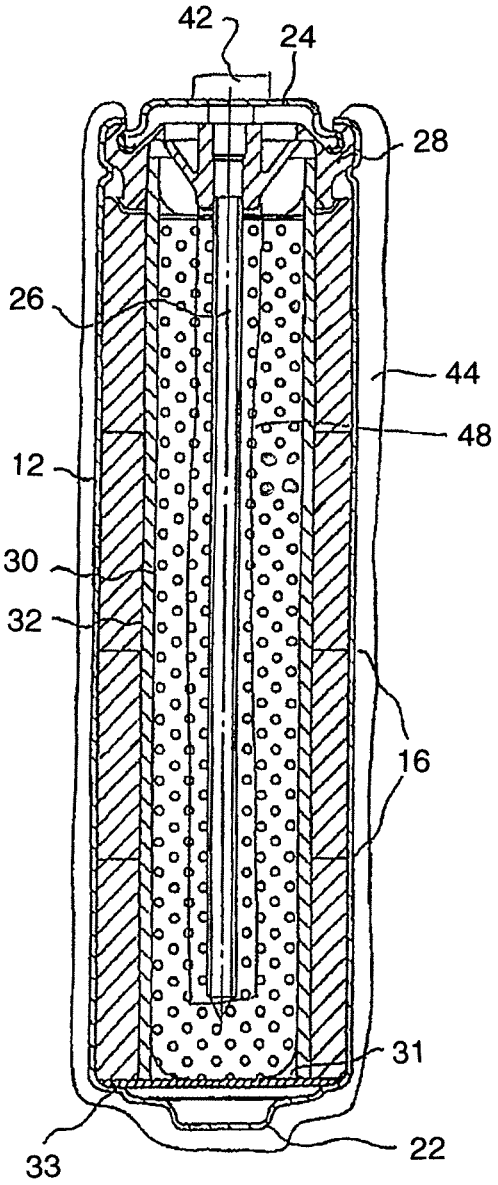
FIG. 4 is a schematic illustration of a corrosion protection method according to the present invention using a third arrangement of anode apparatus.

In FIG. 4 is shown a further embodiment which uses the inert anode 44 but provides an interior supply 48 of solid zinc within the cell so as to ensure longevity of operation due to the presence of sufficient zinc and cathode material within the system to maintain the current flow from the cell through the anode 44 and through the terminal 42 to ensure the cathodic protection of the steel 40. The zinc may be cast rolled, pressed or otherwise formed.

Figure 5:
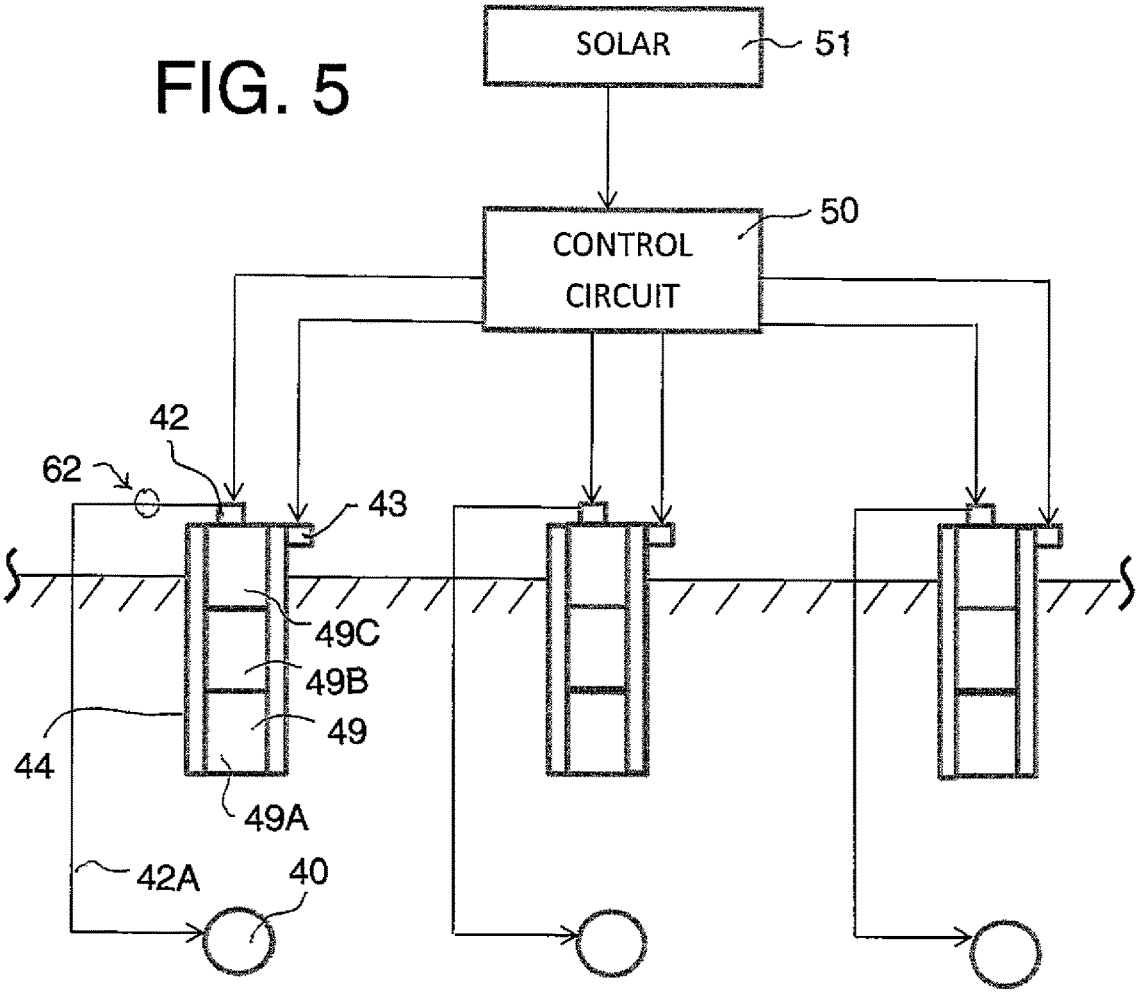
FIG. 5 is a schematic illustration of a corrosion protection method according to the present invention using a fourth arrangement of anode apparatus, showing a connection of the components for re-charging.

Turning now to FIG. 5 there is shown a system for recharging the batteries or cells of the type shown in FIG. 1. It will be appreciated that the combination forming the anode assembly can be formed by a single cell where the casing of the cell directly surrounds the cell and is directly attached to the anode. In other arrangements schematically shown in FIG. 5 the current is supplied by a battery 49 defined by separate cells 49A, 49B and 49C. The cells can be constructed in any suitable arrangement and the assembly into a battery is shown only schematically in FIG. 5. The construction includes the anode 44 which is located on an exterior casing of the battery 49. The battery includes the first terminal 42 and the second terminal 43.

A recharging system 50 is provided which can be used to recharge each of the batteries 49. The recharging system 50 can comprise a conventional rectifier type power source generating a suitable voltage output for connection across the batteries. Alternatively a solar source 51 can be used to generate electrical power which is controlled by the charger 50 to be applied to the batteries 50.

Each of the cells is constructed in a manner which allows the cell to be recharged. Such rechargeable cells are of course well-known and their construction is available from many different prior disclosures.

In the arrangement shown in FIG. 5 each of the batteries is embedded within the concrete in a manner which leaves the terminals 42 and 43 or electrical connections to these terminals exposed for connection to the battery charger 50. The terminals may comprise simply contact points or wires and it is not intended that the terminals require any particular construction or require any connection component for connection to the output leads or connectors on the charger. It is simply required that there be a connection when required between the charger and the battery.

With the batteries in place in the concrete the charger can be used to recharge each of the batteries while those batteries remain in place. The charger 50 can be arranged for connection to the plurality of batteries within a structure and can be arranged to provide repeated automatic recharging of those batteries at set periods to ensure that the voltage of the batteries remains at a required level. Alternatively the system may be managed as part of a maintenance system so that the batteries are recharged manually by manual connection when required, for example after a known period during which it is expected that discharge to an unacceptably low capacity will occur.

As indicated at 62 is provided a switch or disconnect mechanism which is used to disconnect the cell from the metal section 40 in the event that it is required that no additional current is supplied to the metal section during the charging process.

In FIG. 5 is shown that the recharging process is carried out by applying a voltage between the terminal 42 and the terminal 43 of the battery. However it will be appreciated that it is also possible to carry out the recharging by providing a connection to the battery at the casing or at the anode 44 and a further connection to the terminal 42 or to the wire which connects to the steel 40 or directly to the steel 40. If the steel within the structure is electrically interconnected, multiple batteries may be charged by using a single connection to the steel 40 in combination with connection to terminal 43 of multiple batteries.

Figure 6:
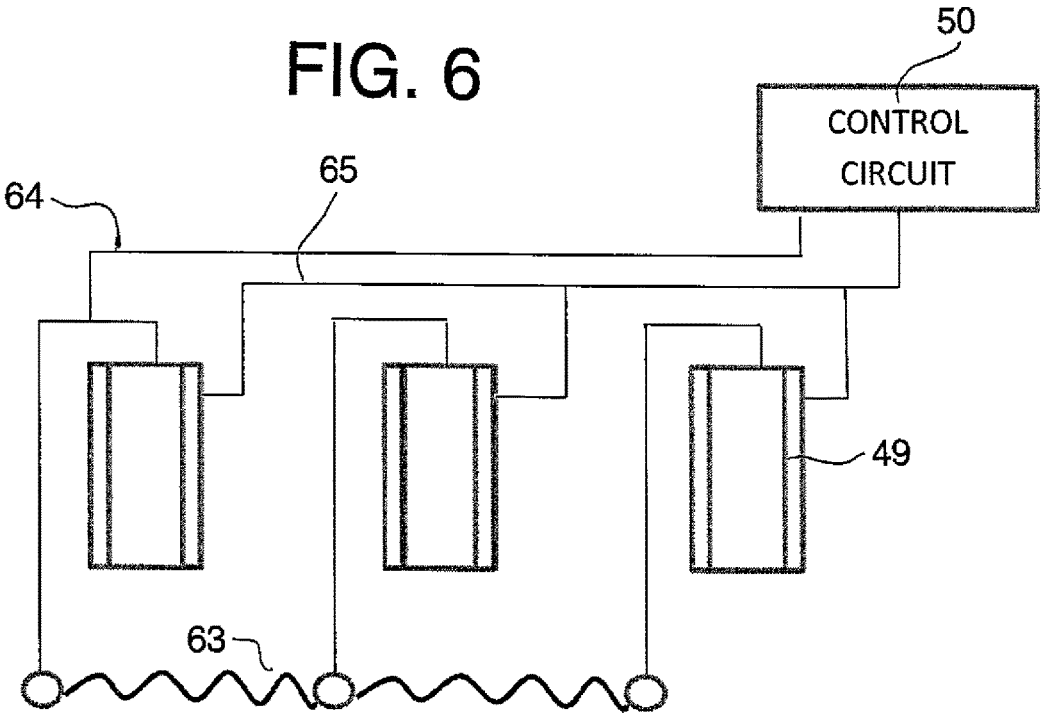
FIG. 6 is the schematic illustration of another arrangement of FIG. 1 which can be used showing an alternative connection of the components for re-charging.

In FIG. 6 is shown another arrangement where the charger 50 is connected to charge the batteries 49 using only two wires 64 and 65 so that a single wire 64 is connected to the steel at one of the steel bars in a case where there is an electrical interconnection between all of the steel bars.

It will further be appreciated that the recharging after installation by an electrical connection of the charger to terminals 42 and 43 while terminal 42 is electrically connected to the metal section 40 will act to pass extra current to the metal section during charging. This will cause passivation of the metal section or reduce future current requirements after the recharging process is complete to maintain passivity or to mitigate corrosion of the metal section.

Figure 7:
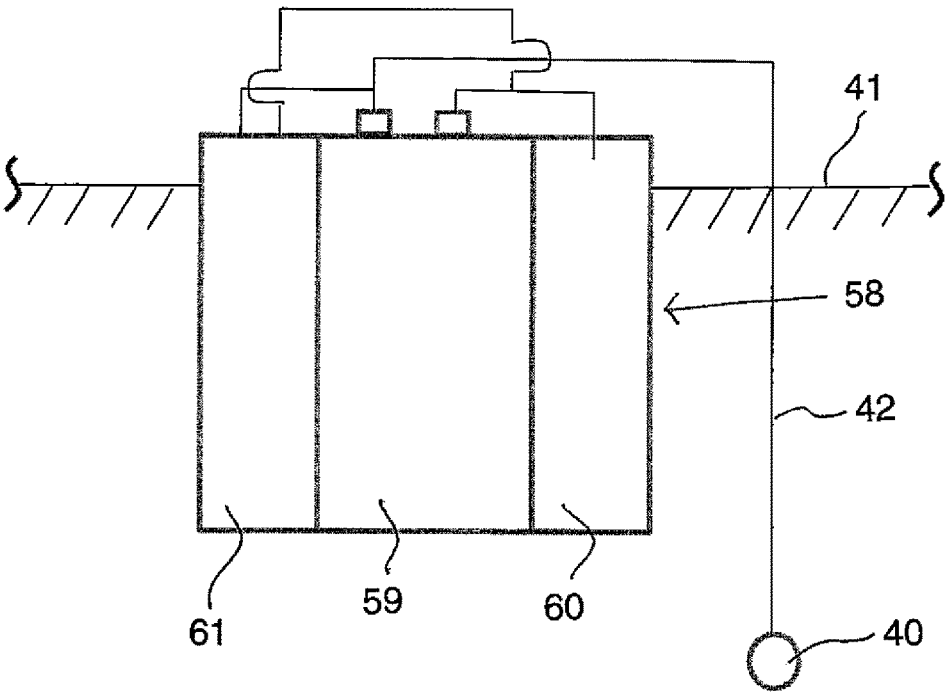
FIG. 7 is a schematic illustration of a corrosion protection method according to the present invention using a further arrangement of anode apparatus.

In FIG. 7 is shown an alternative arrangement 58 where there is provided a cell 59 which is connected to an anode 60 and to the steel 43 and is also connected to a recharging system 61 so as to form an integral construction of these components. Therefore it is not necessary for the anode 60 to surround the cell 59 but the anode can lie alongside or adjacent or otherwise be connected to the cell. The recharging system 61 forms an integral part of the system but does not need to be connected in any particular way to the cell. The recharging system 61 is shown as also contained within or at least in contact with the concrete 41 but of course this is not necessary. The recharging system may include solar panels, batteries, and transformer rectifiers to convert AC to DC power, DC power supplies or other battery chargers.

Figure 8:
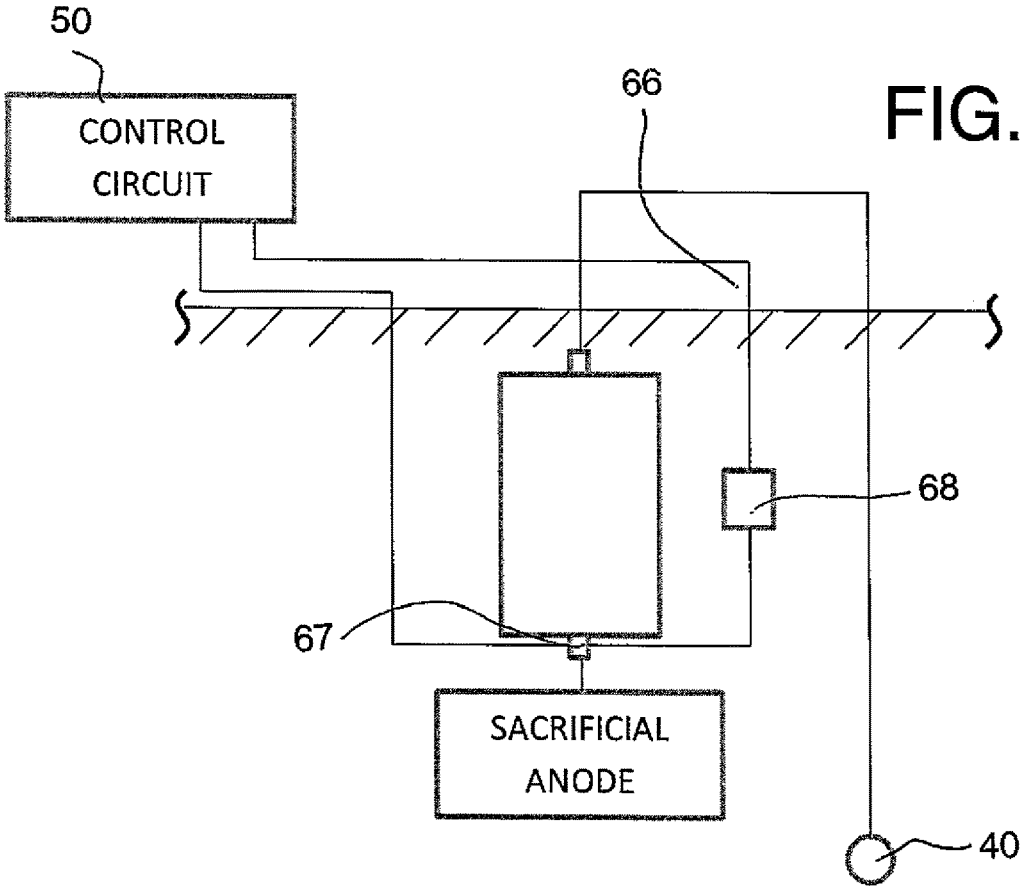
FIG. 8 is a schematic illustration of a further arrangement of the anode apparatus.

In FIG. 8 there is shown a further alternative arrangement in which the sacrificial anode and battery or cell are not a combined unit and are mounted separately in the concrete and connected by an electrical connection. One pole of the cell is therefore connected to the steel 40 and the other pole is connected to the sacrificial anode as shown. In this case the battery is re-charged by the charger 50 which is connected at the terminals 66 and 67. An electrical switching mechanism 68 such as a field effect transistor (FET) is provided connected between the terminals 66 and 67 which switches to be a closed circuit and allows the sacrificial anode to operate in galvanic mode in the event that the battery voltage drops below a threshold and until the battery is re-charged periodically by the charger 50 being brought into the connection for re-charging as shown. The FET 68 operates to reopen the circuit from the closed circuit condition when the charging voltage is applied.

The system therefore can use rechargeable batteries of the type developed by Josef Daniel-Ivad. It has been found that the magnitude of the current that can be delivered to steel in concrete is sufficient to provide an effective protection even when using the above inert anode materials rather than the sacrificial zinc anode. The battery has been found also to provide a reasonable length of operation while delivering a realistic amount of current. In general the battery can provide a significant current using an AA size battery for a period of one to two years. The mean published power capacity an AA battery is around 2.35 Ah and that of a D battery is 15 Ah. A standard D battery would thus be expected to last approximately 6 to 12 years depending on the level of current output. It is realistic that a specially designed battery can be manufactured to last a minimum of 10 years. The D size battery is of realistic size and zinc mass to function to provide the current for the anode.

Figure 9:
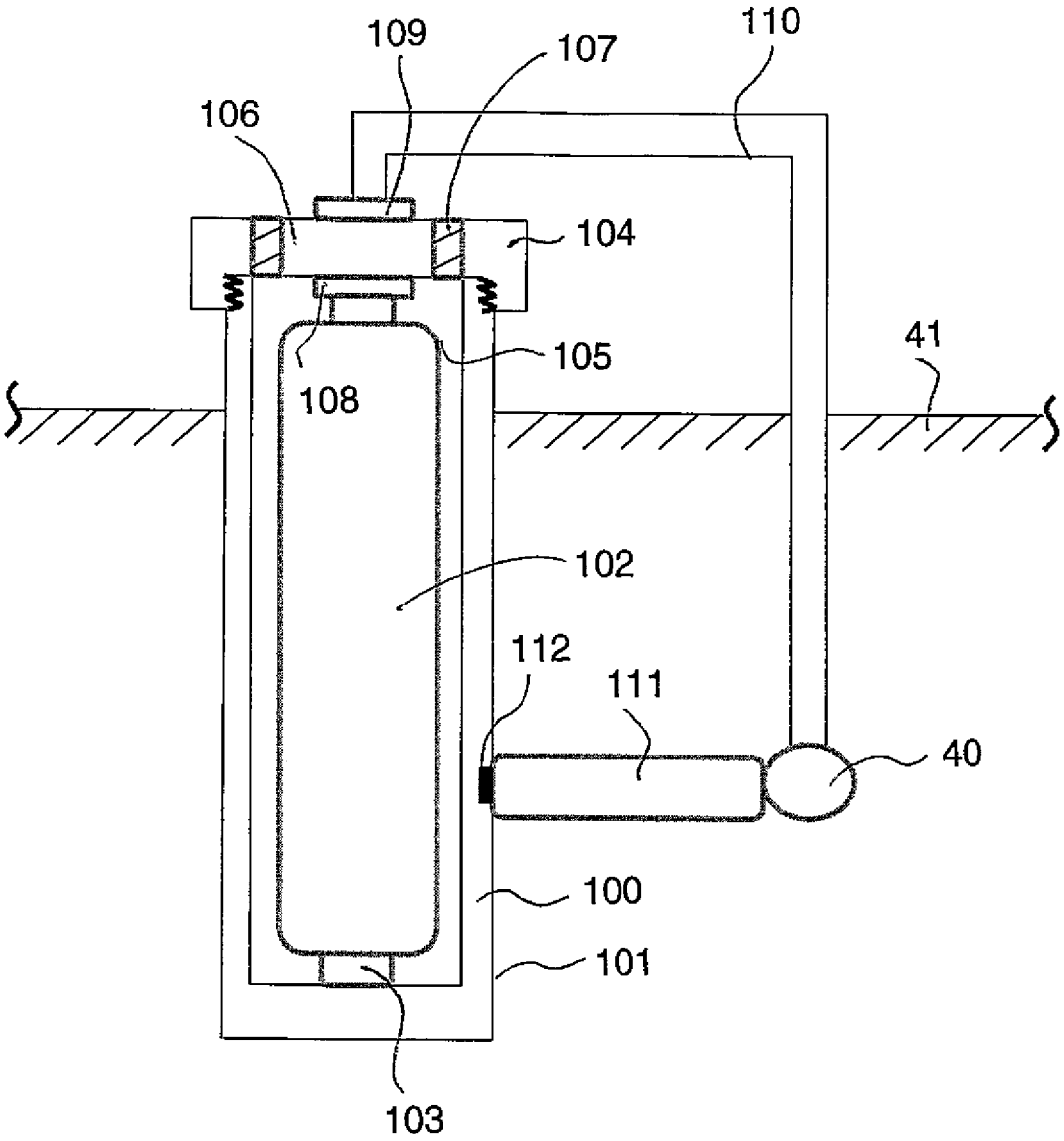
FIG. 9 is a schematic illustration of a further embodiment of corrosion protection method according to the present invention using another arrangement of anode apparatus.

In FIG. 9 is shown a schematic illustration of a further embodiment of corrosion protection method according to the present invention using a further arrangement of anode apparatus where the battery or other storage component for the charge is replaceable. This is shown as a casing or enclosure 100 with outer surface 101 forming the anode in the manner previously described. Thus the casing 100 can be formed entirely of anode material or may be covered by a layer of the anode material. Inside the casing is provided a cell 102 with one terminal 103 connected to the casing so as to electrically communicate therewith. The casing includes a top cover 104 which is arranged to be sealed onto a top opening 105 of the casing. The top cover 14 includes a centre terminal 106 insulated from the casing itself by suitable insulation 107. The terminal 106 includes a portion 108 connecting to the other terminal of the battery and a portion 109 connected to the wire 110 communicating with the steel 40. In this arrangement, instead of charging the battery 102, the battery can be replaced by removing the top cover and inserting a new battery into engagement with the casing at one terminal and with the cover at the other terminal of the battery. This replacement can be carried out while the casing remains in place within the concrete material 41 simply by providing the top cover in an exposed position. The casing 100 has its outer surface remaining in contact with the concrete.

The anode formed by the casing may have a noble or non-sacrificial material positioned outside or otherwise separate from a portion or layer of sacrificial anode material so that cathodic protection provided by the noble anode is not interfered with by buildup of corrosion products from the sacrificial anode material. Thus in FIG. 9 an additional layer or portions (not shown) of an inert or non-sacrificial anode material is applied outside layer 101.

The assembly may be used with a non-conductive stand off or spacer 111 to prevent the anode from electrically contacting the steel resulting in a short circuit. The non-conductive standoff may be an integral part of the anode assembly and may be attached to the anode assembly for example by the attachment member 112. Attachment may be made at any suitable location on the anode assembly. The nonconductive standoff may be used to hold the anode in place during concrete placement. Nonconductive standoff may form a non-perforated layer between the anode and the steel to allow the anode to be installed close to the steel and maintain reasonably uniform ionic current distribution to the steel section. This arrangement is particularly important in patch repair where a section of the concrete is removed adjacent to the steel and the anode assembly is inserted into the opening or hole generated by the concrete removal. This arrangement is also important in new construction applications where the steel is exposed and it is desired to prevent contact between the anode assembly and the steel and provide more uniform current distribution to the steel. In these situations the location of the anode assembly should be controlled by the provision of a suitable standoff member 111 shown above.

Where a cylindrical anode assembly is used with a drilled hole, the drilled hole can be arranged to approximately match the shape of the anode assembly so that the provision of the spacer 111 is not required. A filler material can be inserted into the hole to provide ionic connection and maintain the anode assembly in position.

In one embodiment, the case of the cell is formed of a sacrificial anode material and this material corrodes and is consumed during operation of the assembly. When the sacrificial anode material is consumed in at least one location, the cell will be perforated and they will therefore be ionic contact between the electrolyte within the cell and the ionically conductive material or concrete. The remaining portion of the case which is formed of the sacrificial material will continue to corrode relative to the cathode of the cell, as these two components are now in ionic contact with each other. This reaction will consume sacrificial and material from the casing and reduce the ability of the casing to function as an effective anode.

If the anode of the cell is formed of zinc or some other material which is less noble than steel, the anode of the cell will begin to function as a sacrificial anode relative to the steel as there is now an ionic connection between the anode of the cell and the steel. In this manner the assembly typically will continue to provide corrosion protection to the steel as a simple galvanic anode, after the sacrificial anode material of the casing of the cell is consumed.

This arrangement allows the assembly to provide two-stage corrosion protection for the steel. The first stage provides a higher driving voltage and thus a higher current to the steel cell voltage and the potential between the sacrificial anode material casing and the steel are additive. The second stage provides a lower driving voltage and thus a lower current to the steel. When the cell becomes fully ineffective, the driving voltage is the difference in potential between the anode of the cell and the steel. This anode arrangement can transition from the first stage to the second stage automatically without any intervention.

In some arrangements as described herein the storage component is associated with a sacrificial anode. The storage component may be rechargeable or replaceable so as to extend the life of the anode assembly well beyond the life of a single charge of the storage component. At the same time however if the amount or positioning of sacrificial anode material generates sufficient corrosion products to reduce or halt the protection process, the recharging or replacement of the cell may no longer become effective. It is necessary therefore to choose an amount of sacrificial anode material which matches the ability of the assembly to continue to operate. This can be overcome in some cases by providing also an inert anode material as part of the anode body which may be provided as a layer inside the sacrificial material. Thus when the sacrificial material is depleted before the operation of the system is degraded by the presence of corrosion products, the assembly continues to operate using the inert anode which has become exposed.

Figure 10:
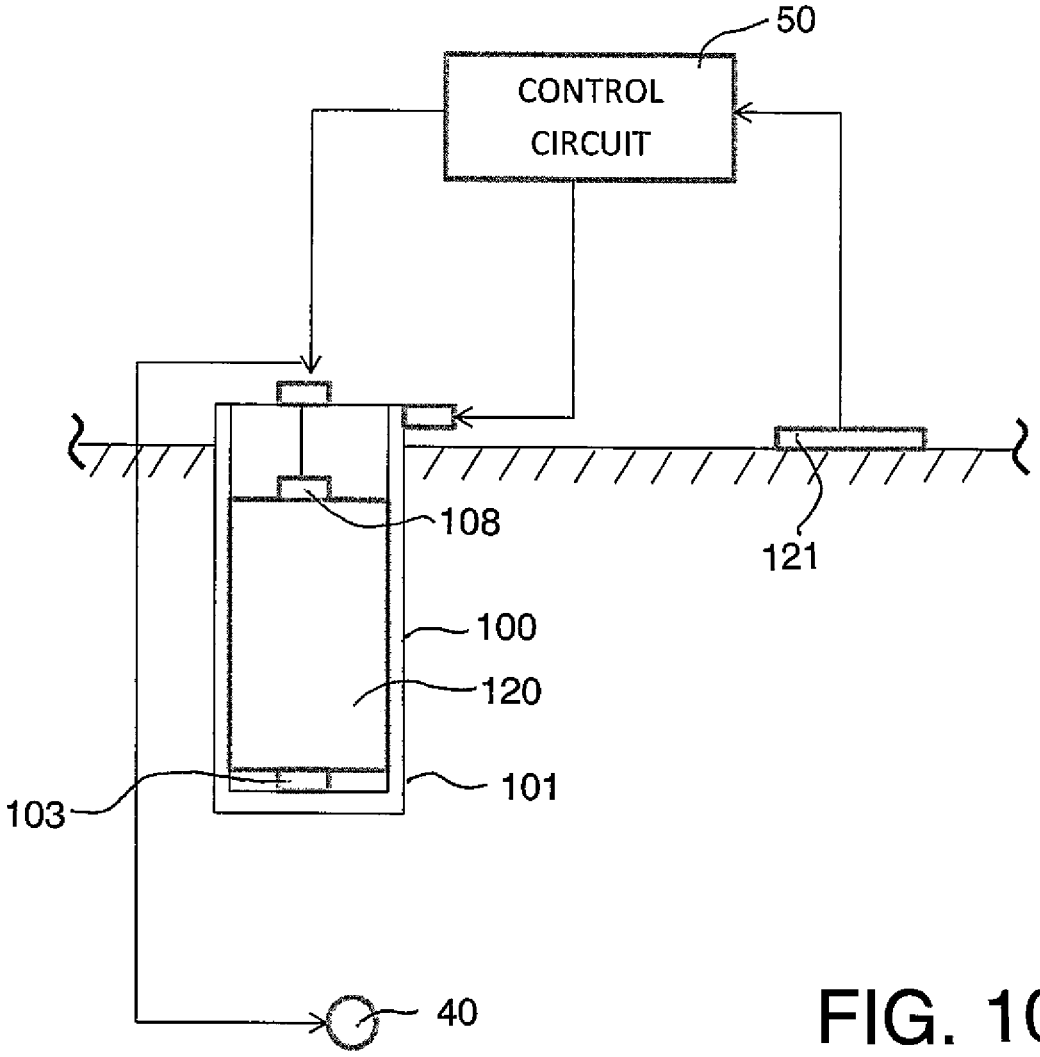
FIG. 10 is a schematic illustration of a further embodiment of corrosion protection method according to the present invention using another arrangement of anode apparatus in which the apparatus uses a supercapacitor which is recharged using a piezo-electric charging system.

In FIG. 10 is shown a further arrangement using a casing or enclosure 100 with outer surface 101 forming the anode in the manner previously described. In this arrangement a storage component is provided by a supercapacitor 120 and is connected by the terminals 103 and 108 to the terminal 109 and the case 100 as previously described. In this embodiment the control circuit 50 receives charging current from a piezo-electric charging system 121 which is actuated by loading or movement of the concrete structure to which it is attached for example by the movement of vehicles. Such piezo-electric changing systems have previously been known and are available to persons skilled in this art for generating an ongoing current which can be applied to the supercapacitor for storage to replace current depleted to carry out the impressed current cathodic protection. The capacitor 120 is contained within the container 100 which provides the anode on the outer surface as an integral component therewith. Such capacitors typically have an outer container wall of a plastics material so as to protect and insulate the operating components and this can be inserted into the container 100 as a separate component, or the container and anode can be formed onto the outer surface of the housing of the capacitor. The capacitor can be replaced if necessary by insertion of a new capacitor into the container.

Daily recharging can easily be provided by solar panels, for example, but other means of producing reasonably regular bursts of current could be used as charging components for the storage component such as the supercapacitor in this example. An example of such could be piezoelectric materials which can be incorporated in roads, parking garages, bridges, runways etc. enabling current to be generated by loading or movement of the structure or vehicles passing over them.

That is, piezoelectric materials could be used to generate electricity to power an impressed current system directly, or to charge/recharge batteries or capacitors/supercapacitors.

EXAMPLES

In one example a Duracell D size battery was stripped of its label and was directly inserted into a hole in a reinforced concrete slab of dimension 28×19×10.5 cm high. The bare metal casing of the battery was partially inserted into a 42 mm diameter hole which was 38 mm deep. The space between the battery and the inner surface of the hole was filled with ionically conductive gel comprised of lithium hydroxide, water and carboxymethylcellulose. The other terminal of the battery was is connected to all of the steel bars in the concrete slab (four transverse and two longitudinal bars, each 2 cm in diameter) such that electrons flowed to the steel and the steel would be protected. An arrangement of this type when tested gave an initial current of around 3 mA and maintained a current of over 1 mA for 145 days. The barrel itself is nickel coated steel which is not totally inert. Once there is a break in the nickel coating, corrosion of the steel will occur under the conditions that prevail at the surface of the metal. This may be overcome by providing a coating which may be thicker or a coating which is a more effective inert anode material such as MMO coated titanium, titanium sub-oxide, platinum, niobium or any other such material. The steel barrel may also be replaced with a barrel which is wholly made of more effective inert anode material as listed above.

If the steel barrel is allowed to corrode, it will eventually perforate such that the battery is no longer a closed cell. If this happens, some or all of the ionic current from the anode of the battery may flow directly to the reinforcing steel instead of flowing to the cathode of the battery. This would compromise the added voltage of the battery but it would allow the anode of the battery to continue to protect the reinforcing steel as a simple galvanic system.

A two battery setup can be used. In a second example, a sample as described above was prepared and a second battery was connected in series with the first battery. The casing of the first battery was directly inserted and used as the anode. This arrangement increased the driving voltage by a factor of two and surprisingly, the current to the steel reinforcement increased by a factor of three to four. Initial current was 9.5 mA and a current of 3 to 4 mA was maintained for over 110 days. Further batteries (#3 and #4) were added in series to further increase the driving voltage. The increase in current to the steel reinforcement was roughly proportional to the increase in voltage.

In a further example, a D size battery was connected to various noble and sacrificial anode materials including MMO coated titanium, titanium sub-oxide tube, brass and zinc. Testing was completed on reinforced concrete blocks of the same dimensions as described above. The anodes were embedded in the concrete hole using ionically conductive gel. Batteries were electrically connected to the anode materials and to the reinforcing steel. The non-inert anodes especially zinc delivered higher initial current than the inert anodes. Nonetheless a current of at least 1 mA was achieved by all anodes.

In a further example, a stainless steel anode was used and was embedded in compacted sand dosed with a saturated solution of lithium hydroxide. The stainless steel anode was used to pass 30 to 50 mA current for a period of 14 days. Minimal corrosion was evident on the stainless steel anode surface after passing a total charge of 12.5 A-hrs of charge.

In yet a further series of examples, zinc alkaline rechargeable AA size batteries were connected to mixed metal oxide (MMO) coated titanium and zinc anodes which were partially embedded in ionically conductive gel in a hole in a reinforced concrete block as described above. In each case the anode was connected to the terminal marked + and the steel was connected to the terminal marked − on an as received rechargeable battery. Current flowing to the steel was recorded. The battery was then disconnected and discharged. After discharging the battery the voltage of the battery was measured to confirm it was discharged. The battery was then recharged and reconnected. The current was recorded after the battery was recharged. These steps were taken with both the inert MMO titanium anode and the sacrificial zinc anode.

The current produced when the battery was connected to the sacrificial anode was greater than the current produced when the battery was connected to the inert MMO coated titanium anode. In both cases the current from the recharged battery exceeded the current from the original battery.

The concept of using a battery or a rechargeable battery of the type described herein is an improvement over the conventional galvanic anode available in the market. A current output of more than 1 mA can be maintained for many weeks without a significant drop in the battery voltage indicating that cathodic protection can be maintained for several years. An inert anode such as MMO coated titanium can be wrapped around, coated onto or otherwise electrically connected to the casing of the battery. Alternatively the barrel of the battery may partially or fully comprise titanium and can be coated with MMO or titanium sub-oxide. A portion of sacrificial anode material such as zinc can be provided in combination with an inert anode to provide additional current until the sacrificial portion is consumed. The outer barrel of the battery can also be used as an impressed current anode in cases where an additional power supply is used to provide an initial charge to passivate the steel. Specially designed batteries can be modified to provide the desired parameters for this application such as low current, long life operation and to be more suitable for direct embedment into the concrete.

Figure 11:
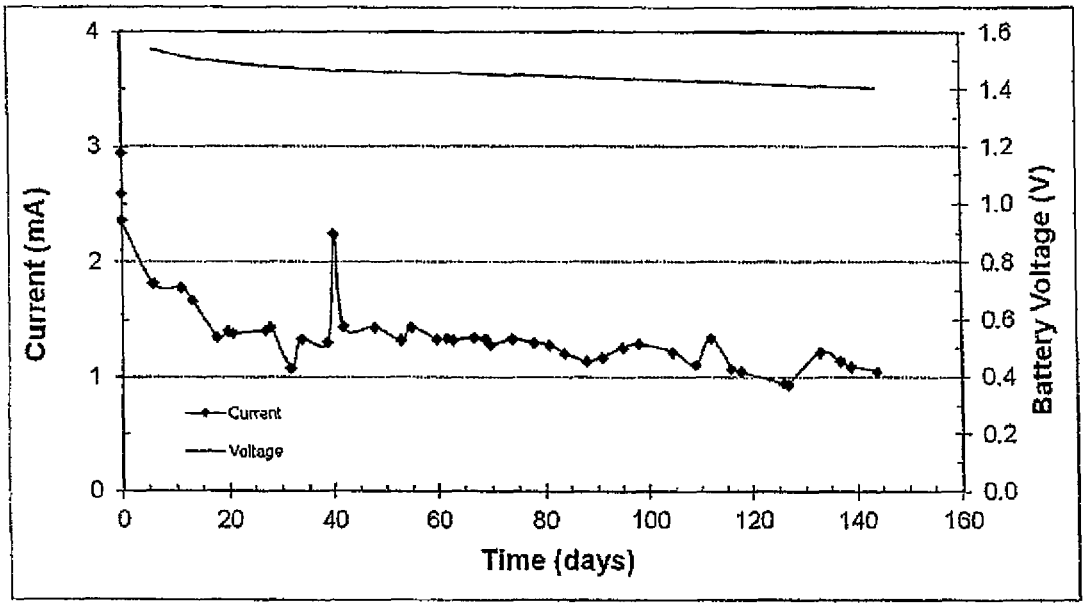
FIGS. 11 and 12 are battery anode progress graphs of voltage and current vs time for the battery casing directly inserted in the hole in the concrete slab with FIG. 10 showing a graph relating to a second battery connected in series to the first battery as described in the first set of examples.
Figure 12:
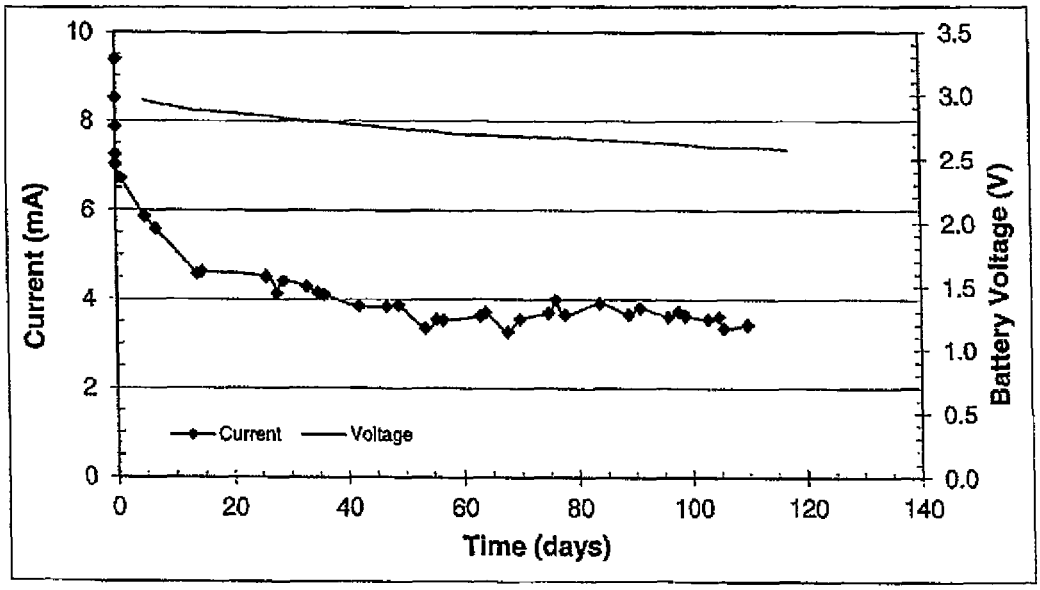

FIGS. 11 and 12 are battery anode progress graphs of voltage and current vs time for the battery casing directly inserted in the hole in the concrete slab with FIG. 10 showing a graph relating to a second battery connected in series to the first battery as described in the first set of examples.

Figure 13:
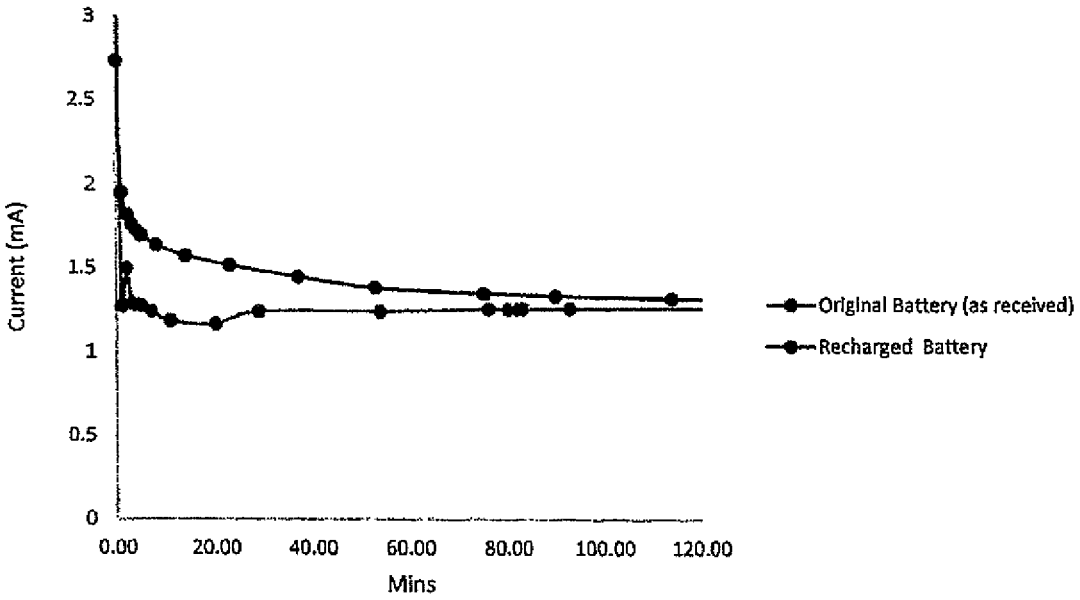
FIG. 13 shows a graph of results for an assembly as described herein with a battery and a MMO coated titanium anode showing current before (as received) and after recharging where the results are set out in Tables 1 and 2 hereinafter.

FIG. 13 shows a graph of results for an assembly as described herein with a battery and a MMO coated titanium anode showing current before (as received) and after recharging, based on the results set out hereinafter in Tables 1 and 2.

Figure 14:
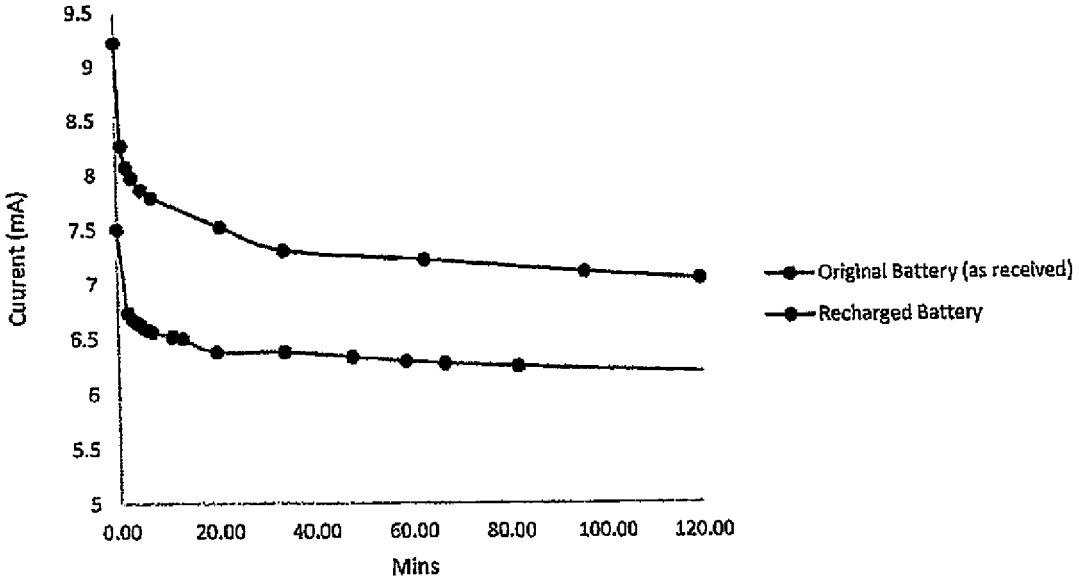
FIG. 14 shows a graph of results for an assembly as described herein with a battery and a Zn anode showing current before (as received) and after recharging where the results are set out in Tables 3 and 4 hereinafter.

FIG. 14 shows tables and a graph of results for an assembly as described herein with a battery and a Zn anode showing current before (as received) and after recharging, based on the results set out hereinafter in Tables 3 and 4.

TABLE 1

Ti MMO
Area of Ti MMO exposed 6 cm2
Battery Igo Green 1.5 V
Negative terminal of the battery is connected to 6 bars of steel, positive terminal of the battery connected to the MMO titanium ribbon anode
MMO titanium ribbon is placed in a conductive gel in the concrete sample.
Initial voltage of battery 1.571 V for the
Original Battery in as received condition.

| Date | Time | Current mA | Voltage V |
|---|---|---|---|
| 24 Sep. 2015 | 10:48 | 3.8 | |
| 24 Sep. 2015 | 10:49 | 1.27 | |
| 24 Sep. 2015 | 10:50 | 1.5 | |
| 24 Sep. 2015 | 10:51 | 1.29 | |
| 24 Sep. 2015 | 10:52 | 1.277 | 1.542 |
| 24 Sep. 2015 | 10:53 | 1.273 | |
| 24 Sep. 2015 | 10:55 | 1.24 | |
| 24 Sep. 2015 | 10:59 | 1.183 | |
| 24 Sep. 2015 | 11:08 | 1.166 | |
| 24 Sep. 2015 | 11:17 | 1.241 | |
| 24 Sep. 2015 | 11:42 | 1.243 | |
| 24 Sep. 2015 | 12:04 | 1.258 | |
| 24 Sep. 2015 | 12:08 | 1.256 | |
| 24 Sep. 2015 | 12:10 | 1.258 | |
| 24 Sep. 2015 | 12:11 | 1.259 | |

TABLE 1-continued

Ti MMO
Area of Ti MMO exposed 6 cm2
Battery Igo Green 1.5 V
Negative terminal of the battery is connected to 6 bars of steel, positive terminal of the battery connected to the MMO titanium ribbon anode
MMO titanium ribbon is placed in a conductive gel in the concrete sample.
Initial voltage of battery 1.571 V for the
Original Battery in as received condition.

| Date | Time | Current mA | Voltage V |
|---|---|---|---|
| 24 Sep. 2015 | 12:21 | 1.262 | |
| 24 Sep. 2015 | 12:57 | 1.268 | |

TABLE 2

Recharged Igo battery connected back to the Ti MMO
Initial Voltage 1.569 V

| Date | Time | Current mA |
|---|---|---|
| 25 Sep. 2015 | 9:02 | 2.731 |
| 25 Sep. 2015 | 9:03 | 1.95 |
| 25 Sep. 2015 | 9:04 | 1.821 |
| 25 Sep. 2015 | 9:05 | 1.762 |
| 25 Sep. 2015 | 9:06 | 1.725 |
| 25 Sep. 2015 | 9:07 | 1.697 |
| 25 Sep. 2015 | 9:10 | 1.64 |
| 25 Sep. 2015 | 9:16 | 1.575 |
| 25 Sep. 2015 | 9:25 | 1.519 |
| 25 Sep. 2015 | 9:39 | 1.449 |
| 25 Sep. 2015 | 9:55 | 1.385 |
| 25 Sep. 2015 | 10:17 | 1.351 |
| 25 Sep. 2015 | 10:32 | 1.339 |
| 25 Sep. 2015 | 10:56 | 1.324 |
| 25 Sep. 2015 | 11:03 | 1.321 |

TABLE 3

Zinc rod anode
Area of Zinc exposed 6 cm2
Battery Igo Green 1.5 V AA size
Negative terminal as marked on the battery is connected to 6 bars of steel, positive terminal of the battery connected to the zinc rod anode.
Zinc rod is placed in a conductive gel (lithium hydroxide, carboxymethylcellulose and water) in the concrete reservoir.
Original Battery: Initial voltage of battery 1.5694 V (as received)

| Date | Time | Current mA | Voltage V |
|---|---|---|---|
| 22 Sep. 2015 | 9:27 | 7.505 | |
| 22 Sep. 2015 | 9:29 | 6.737 | |
| 22 Sep. 2015 | 9:30 | 6.678 | |
| 22 Sep. 2015 | 9:31 | 6.642 | |
| 22 Sep. 2015 | 9:32 | 6.613 | 1.542 |
| 22 Sep. 2015 | 9:33 | 6.58 | |
| 22 Sep. 2015 | 9:34 | 6.561 | |
| 22 Sep. 2015 | 9:38 | 6.518 | |
| 22 Sep. 2015 | 9:40 | 6.498 | |
| 22 Sep. 2015 | 9:47 | 6.38 | |
| 22 Sep. 2015 | 10:01 | 6.377 | |
| 22 Sep. 2015 | 10:01 | 6.332 | |
| 22 Sep. 2015 | 10:15 | 6.294 | |
| 22 Sep. 2015 | 10:26 | 6.273 | |
| 22 Sep. 2015 | 10:34 | 6.245 | |
| 22 Sep. 2015 | 11:29 | 6.191 | |
| 22 Sep. 2015 | 11:46 | 6.176 | |
| 22 Sep. 2015 | 11:48 | 6.174 | 1.523 |
| 22 Sep. 2015 | 11:52 | 6.172 | |

TABLE 4

| Recharged Igo battery connected back to the zinc rod anode Initial Voltage 1.644 V | | | |
|---|---|---|---|
| Date | Time | Current mA | Voltage V |
| 25 Sep. 2015 | 11:48 | 9.222 | |
| 25 Sep. 2015 | 11:49 | 8.268 | |
| 25 Sep. 2015 | 11:50 | 8.07 | |
| 25 Sep. 2015 | 11:51 | 7.975 | |
| 25 Sep. 2015 | 11:53 | 7.864 | |
| 25 Sep. 2015 | 11:55 | 7.795 | |
| 25 Sep. 2015 | 12:09 | 7.522 | |
| 25 Sep. 2015 | 12:22 | 7.308 | |
| 25 Sep. 2015 | 12:51 | 7.219 | |
| 25 Sep. 2015 | 13:24 | 7.107 | 1.576 |
| 25 Sep. 2015 | 13:48 | 7.041 | |
| 25 Sep. 2015 | 14:07 | 7.015 | |

Since various modifications can be made in my invention as herein above described, and many apparently widely different embodiments of same made within the spirit and scope of the claims without department from such spirit and scope, it is intended that all matter contained in the accompanying specification shall be interpreted as illustrative only and not in a limiting sense.

The invention claimed is:

1. A method for cathodically protecting and/or passivating a metal section in an ionically conductive material, comprising:

providing a storage component of electrical energy with two poles;

providing an anode for communication of an electrical current to the metal section in the ionically conductive material where the anode is of a material which is not sacrificial to the metal section;

electrically connecting one pole to the metal section, electrically connecting the other pole to the anode and placing the anode in ionic contact with the ionically conductive material such that the electrical current can flow from the storage component through the electrical connection to the metal section;

wherein the anode comprises at least part of an outer surface of an outer case of the storage component.

2. The method according to claim 1 wherein replacement electrical energy is introduced into the storage component while in situ.

3. The method according to claim 2 wherein the anode and the storage component are both at least partly contained in the ionically conductive material.

4. The method according to claim 2 wherein the storage component is connected as a single unit with the anode.

5. The method according to claim 2 wherein the outer case comprises a closed or sealed canister defining the anode on said outer surface.

6. The method according to claim 2 wherein the replacement electrical energy is introduced by re-charging the storage component.

7. The method according to claim 6 wherein the storage component is subsequently re-charged by a solar cell.

8. The method according to claim 6 wherein the storage component is subsequently re-charged by a piezo-electrical cell.

9. The method according to claim 6 wherein the storage component is subsequently automatically repeatedly re-charged.

10. The method according to claim 6 wherein the storage component is subsequently re-charged by a recharging power supply which is an integral unit with the storage component.

11. The method according to any claim 6 wherein there is an electrical connection to allow charging of the storage component by a recharging power supply without current from the recharging power supply going to the metal section.

12. The method according to claim 6 wherein the storage component is charged after installation while electrical connection to the metal section is maintained which acts to pass extra current to the metal section to passivate the metal section or reduce future current requirement to maintain passivity or mitigate corrosion of the metal section.

13. The method according to claim 1 wherein the storage component is a cell or battery of cells.

14. The method according to claim 1 wherein the storage component is a capacitor.

15. The method according to claim 1 wherein the anode comprises stainless steel.

16. The method according to claim 1 wherein said anode is collated with a body of sacrificial anode material acting as a sacrificial anode and wherein the sacrificial anode and the storage component is arranged such that, when the storage component is discharged, the sacrificial anode operates such that electrons can flow from the sacrificial anode through the electrical connection to the metal section.

17. The method according to claim 1 wherein said anode is collated with a body of sacrificial anode material.

18. The method according to claim 1 wherein the outer case comprises a container and after a period of operation, the storage component is replaced in the container with a replacement storage component to provide additional electrical energy.

* * * * *